US010159946B2

(12) United States Patent
Ricci

(10) Patent No.: US 10,159,946 B2
(45) Date of Patent: Dec. 25, 2018

(54) HOMOGENISING PROCESS AND APPARATUS WITH FLOW REVERSAL

(71) Applicant: GEA MECHANICAL EQUIPMENT ITALIA S.P.A., Parma (IT)

(72) Inventor: Alfredo Ricci, Vignale di Traversetolo (IT)

(73) Assignee: GEA MECHANICAL EQUIPMENT ITALIA S.P.A., Parma (IT)

( * ) Notice: Subject to any disclaimer, the term of this patent is extended or adjusted under 35 U.S.C. 154(b) by 563 days.

(21) Appl. No.: 14/651,314

(22) PCT Filed: Dec. 20, 2013

(86) PCT No.: PCT/IB2013/061179
§ 371 (c)(1),
(2) Date: Jun. 11, 2015

(87) PCT Pub. No.: WO2014/097234
PCT Pub. Date: Jun. 26, 2014

(65) Prior Publication Data

US 2015/0298074 A1 Oct. 22, 2015

(30) Foreign Application Priority Data

Dec. 21, 2012 (IT) ..... PR2012A0090

(51) Int. Cl.
*B01F 5/06* (2006.01)
*B01F 15/02* (2006.01)

(52) U.S. Cl.
CPC ..... *B01F 5/0605* (2013.01); *B01F 5/068* (2013.01); *B01F 5/0663* (2013.01); *B01F 5/0681* (2013.01); *B01F 15/026* (2013.01)

(58) Field of Classification Search
CPC ..... B01F 5/0663; B01F 5/068; B01F 5/0681; B01F 5/0605; B01F 15/026
See application file for complete search history.

(56) References Cited

U.S. PATENT DOCUMENTS 2,236,013 A 3/1941 Smith
2,271,982 A 2/1942 Kreveld
(Continued)

FOREIGN PATENT DOCUMENTS

DE 361642 C 10/1922
DE 1258835 B 1/1968
(Continued)

*Primary Examiner* — Queenie S Dehghan
(74) *Attorney, Agent, or Firm* — Pearne & Gordon LLP

(57) ABSTRACT

A homogenizing apparatus (1) comprising: —an inlet (2) for receiving a pressurized fluid, possibly also containing solid particles; —a zone wherein homogenization of the fluid takes place; —an outlet (10) for the fluid at a lower pressure with respect to the inlet pressure, wherein, in the homogenization zone, the fluid passes from a zone having a larger diameter (or volume) to a zone having a smaller diameter (or volume), the homogenization zone comprising an interacting element (9) shared by a first stage (equipped with a first deflector plug (6)) and a second stage suitable for creating back pressure (equipped with a second deflector plug (12)), where the deflector plugs (6 and 12) operate with the interacting element (9) they share, generating an increase in the shear rate within the first stage. The invention also concerns a homogenization process.

4 Claims, 22 Drawing Sheets

(56) References Cited

U.S. PATENT DOCUMENTS

| | | | | |
|---|---|---|---|---|
| 2,274,720 | A | | 3/1942 | Marco |
| 2,662,590 | A | | 12/1953 | Reich |
| 3,164,167 | A | | 1/1965 | Marugg |
| 3,376,023 | A | | 4/1968 | Lage |
| 4,135,829 | A | | 1/1979 | Grillo et al. |
| 4,340,311 | A | | 7/1982 | Crandal |
| 5,217,037 | A | | 6/1993 | Bristol |
| 5,273,407 | A | * | 12/1993 | Jarchau ..... B01F 15/0201 138/45 |
| 5,887,971 | A | | 3/1999 | Gandini et al. |
| 5,893,642 | A | | 4/1999 | Hewitt et al. |
| 5,984,519 | A | | 11/1999 | Onodera et al. |
| 8,061,890 | B2 | | 11/2011 | Subner |
| 2004/0160855 | A1 | | 8/2004 | Rivolta et al. |
| 2007/0263486 | A1 | | 11/2007 | Subner |

FOREIGN PATENT DOCUMENTS

| | | | |
|---|---|---|---|
| DE | 8711740 | U1 | 12/1987 |
| EP | 0810025 | A1 | 12/1997 |
| EP | 0850683 | A2 | 7/1998 |
| FR | 2323437 | A1 | 4/1977 |
| JP | H1142428 | A | 2/1999 |
| JP | 2008207099 | A | 9/2008 |
| RU | 2146966 | C1 | 3/2000 |
| RU | 2434673 | C2 | 11/2008 |
| SU | 784900 | A1 | 12/1980 |

* cited by examiner

Pattern of shear rate traditional mode

Pattern of shear rate new version A

Fig. 3B Pattern of shear rate new version B
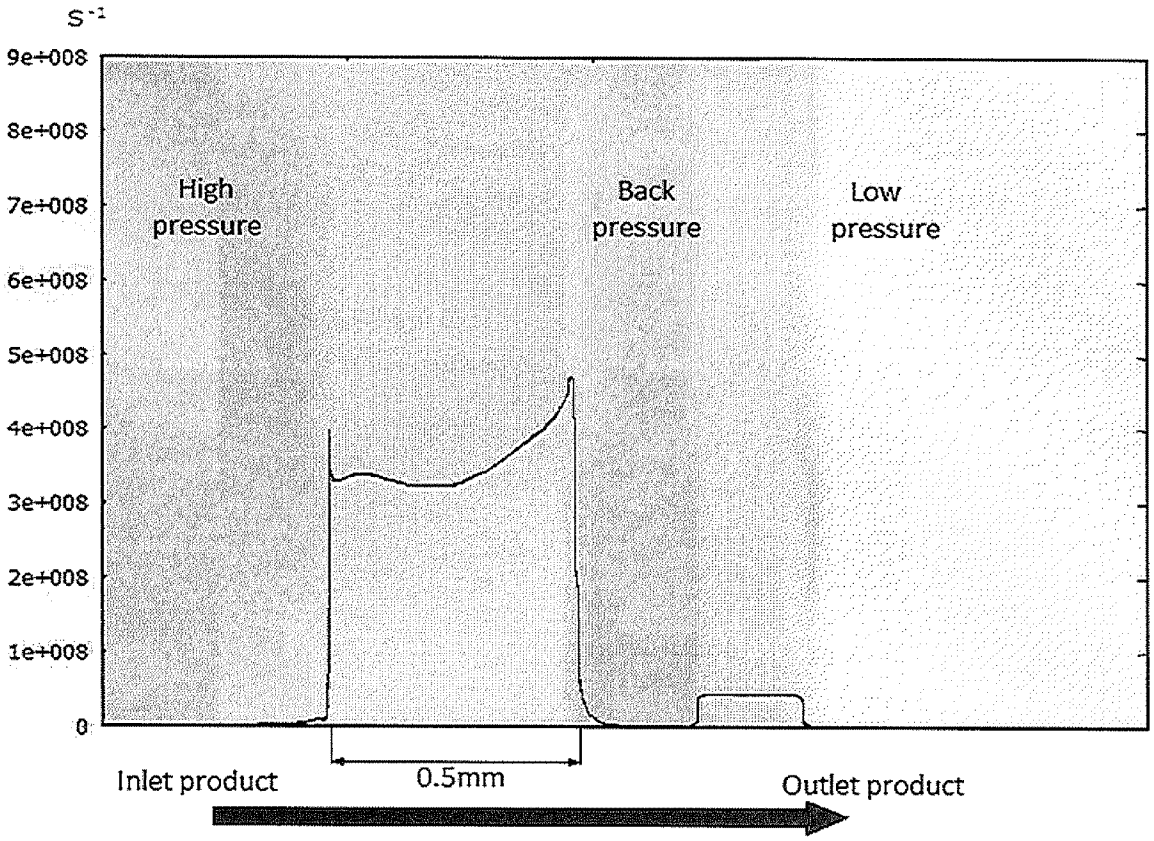

Pattern of shear rate new version C

HOMOGENISING PROCESS AND APPARATUS WITH FLOW REVERSAL

TECHNICAL FIELD

The object of the present invention is a homogenizing process and apparatus with flow inversion.

BACKGROUND ART

The prior art cited in EP 0810025 A1 is considered as the closest known technique.

In fact, the present invention refers to the sector of devices for micronizing fluids, particularly flowable materials containing particles in the liquid state, agglomerates or fibres, that is, products that are substantially liquid and insoluble, but subject to the formation of portions that are solid or in any case, of different densities.

The homogenizing/micronizing apparatus (hereinafter, the terms homogenization and micronization, and other forms thereof, shall be used as synonyms) normally comprises a pump, possibly a high-pressure variable flow pump and a homogenizing valve, having an inlet connected to the delivery of the pump so as to receive the pressurized fluid and an outlet for the homogenized fluid under low pressure.

The micronization to be achieved essentially consists in the breaking down of said particles for the purpose of minimizing the size thereof and rendering the size uniform.

To reach this aim, the fluid is passed through a forced passage, of reduced size, from a first high-pressure chamber (connected to the delivery of the pump) to a second micronizing chamber (connected to the valve outlet).

This passage is defined by a passage head that is solidly constrained (and thus fixed) to a valve body and through which the fluid passes, and by an impact head that is axially movable with respect to the passage head. Specifically, the passage consists in a gap defined between the impact head and the small passage head.

The fluid under high pressure in the first chamber presses on a surface of the impact head, exerting a pressure on it that tends to widen the passage. A pusher is applied to the impact head and it exerts a force on the impact head in an axial direction, so as to oppose the pressure of the fluid.

In this manner, by suitably managing the action of the pusher, it is possible to maintain the breadth of the passage at a desired value that is substantially constant and that can be adjusted in any case. This force should be determined based on the operating flow rate and pressure levels of the homogenizing apparatus.

Therefore, as it flows through said forced passage from the first to the second chamber, the fluid undergoes a drop in pressure, while at the same time it is also accelerated according to the equation of energy conservation. This acceleration leads to a breaking down of the particles of the fluid. Moreover, an impact ring has been known to be arranged in the second chamber so as to intercept the accelerated fluid; in this manner, the fluid strikes against the impact ring at high velocity and this constitutes a further contribution to the breaking up of the particles. The impact ring also protects the chamber in which the impact takes place from wear.

In general, one wants to optimize the energy employed in the homogenization process, that is, with the energy applied to the fluid being equal, one wants to obtain the best possible result for the homogenization of the fluid, in the terms described above, or with the results being the same, one attempts to decrease the energy (pressure) employed.

In the prior art described hereinabove, the product substantially passes through a toroid that tends to widen (cf. FIGS. 1 and 2 of the prior art) and the homogenizing effect is provided by the increased cutting force that the product encounters as it passes from the central channel onwards out of the toroid.

However, much energy is uselessly wasted in the homogenization and micronization step and converted into heat, which is the cause of the intrinsic inefficiency of high-pressure homogenizing apparatuses.

EP 0850683 A1 discloses a fine particle production device, wherein, according to the third embodiment illustrated therein, a pre-treatment unit has been added between the high pressure pump and the fine particle production device. Said third embodiment needs to be integrated or associated with the main device or first embodiment (a system with a fixed geometry and a constant shear rate, which is quite different from the aims of the present invention) and it cannot be used as a stand-alone device.

US 2004/160855 discloses a homogenizing apparatus comprising an inlet for a pressurized fluid, a homogenization zone, an outlet for the fluid at a lower pressure, wherein in the homogenization zone the fluid passes from a zone having a large diameter to a zone having a smaller diameter. The homogenization zone comprises an interacting element shared by a first stage, equipped with a first deflector plug, and a second stage for creating back pressure having a second deflector plug.

However said apparatus lacks efficiency and the deflector plugs are not adjustable independently.

DISCLOSURE OF THE INVENTION

The aim of the present invention is to limit the drawbacks stated above and to realize an improved homogenization-micronization process and apparatus that make it possible to decrease energy waste and thus make them more efficient.

A further aim is to realize this by means of a "stand-alone" device that is capable of creating particle reduction without requiring auxiliary equipment upstream or downstream.

BRIEF DESCRIPTION OF DRAWINGS

Said aims are achieved by the homogenizing-micronizing process and apparatus constituting the object of the present invention, and which are characterized as per the contents of the claims set forth herein below.

Specifically, the normal flow of the product is reversed, that is, the outlet of the prior art is the product inlet in the present invention and the inlet of the prior art is now the outlet.

Moreover, the apparatus, which is of the stand-alone type, has two stages (made up of deflector plugs), the two stages having a cooperating element in common, and the second stage being intended to create back pressure. The deflector plugs operate with the interacting element they share, creating an increase in the shear rate and back pressure within the first stage.

Figure 1:
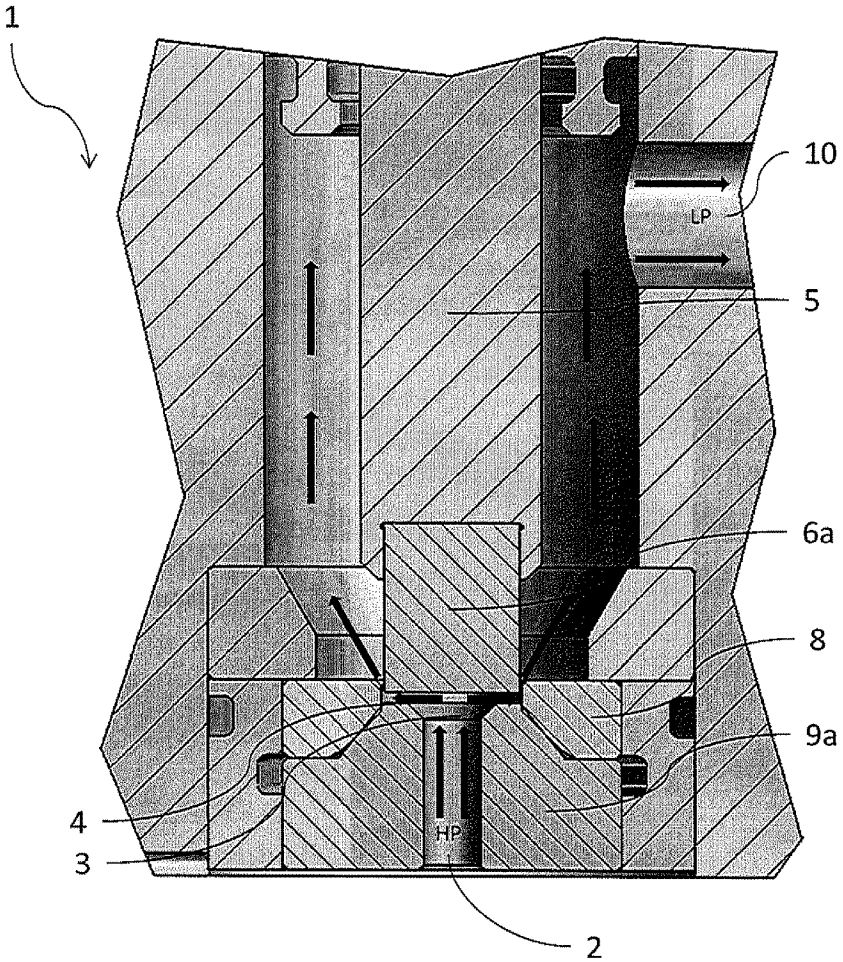
Figure 2:
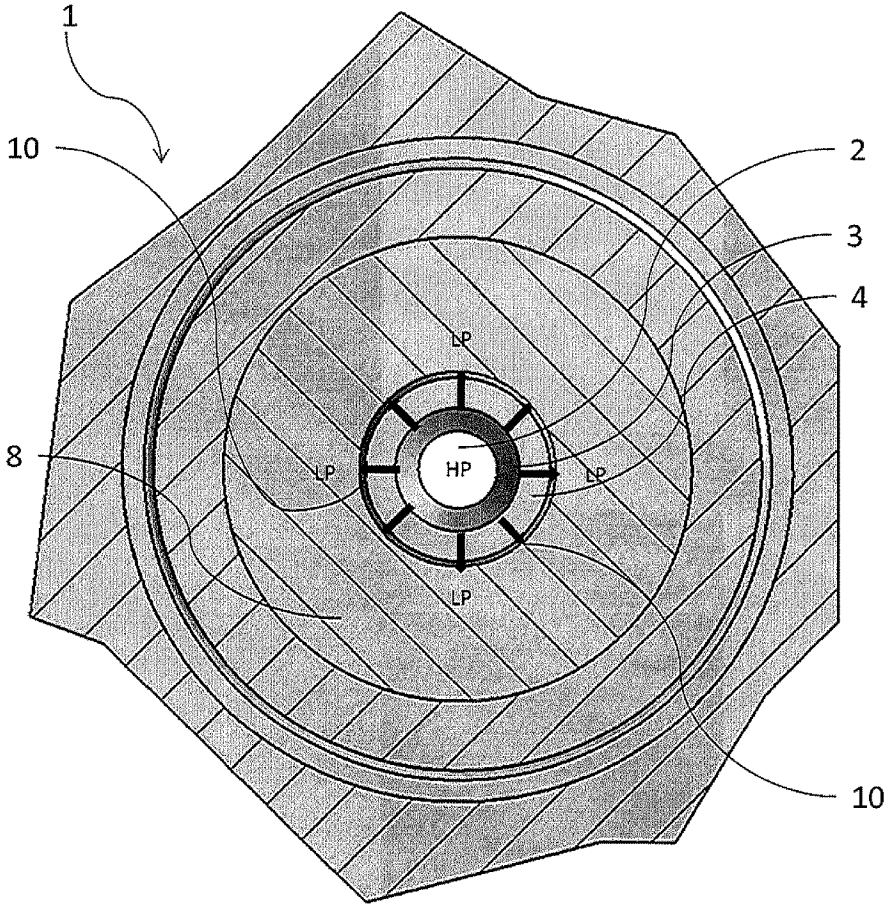
Figure 3:
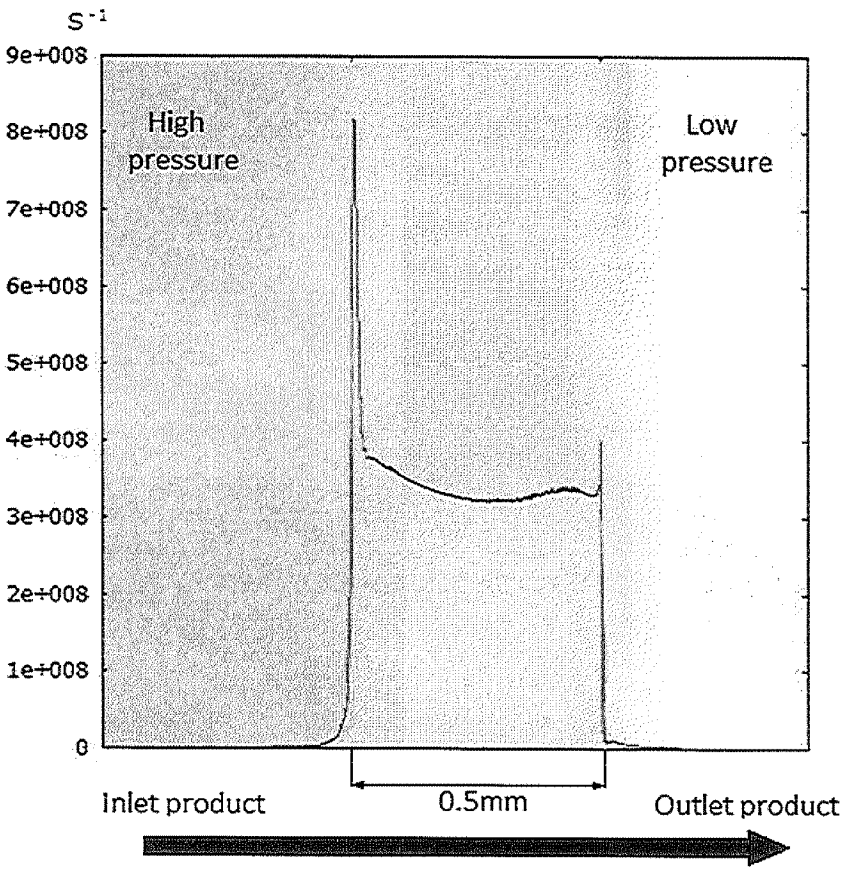
Figure 3A:
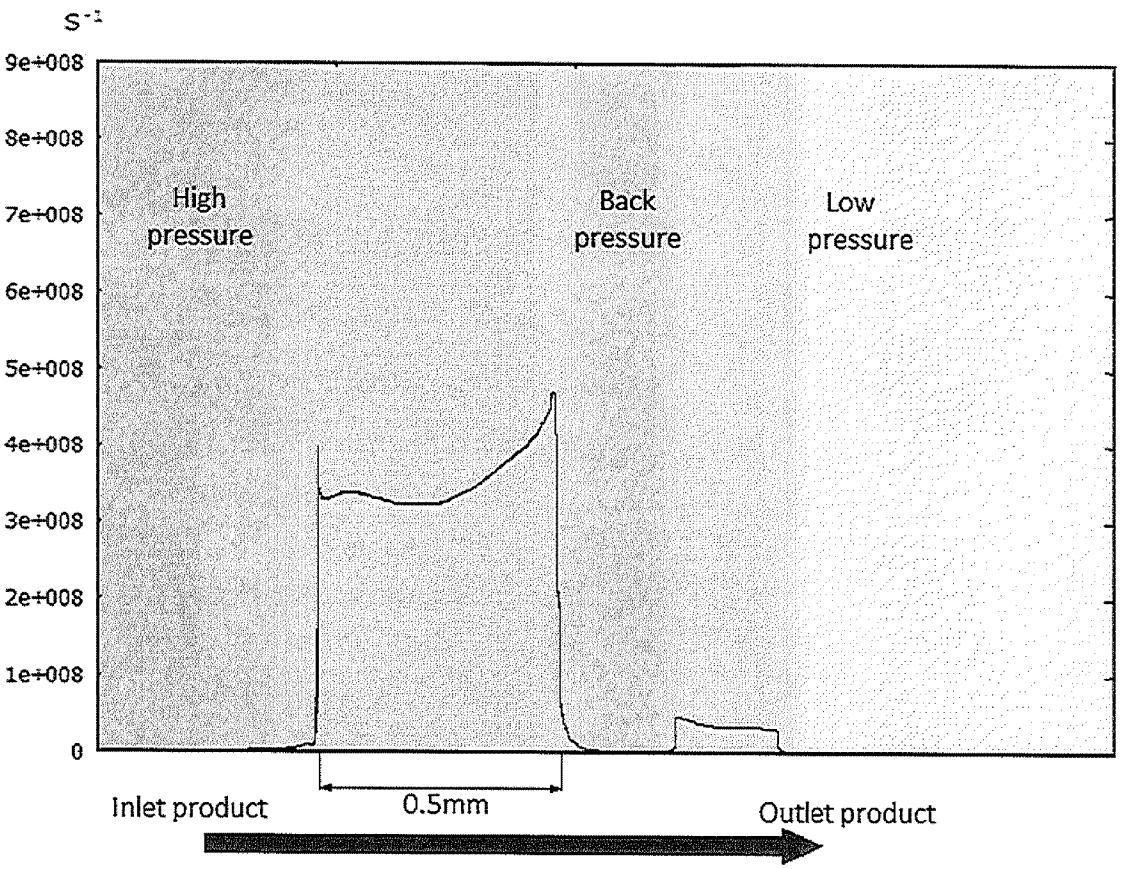
Figure 3C:
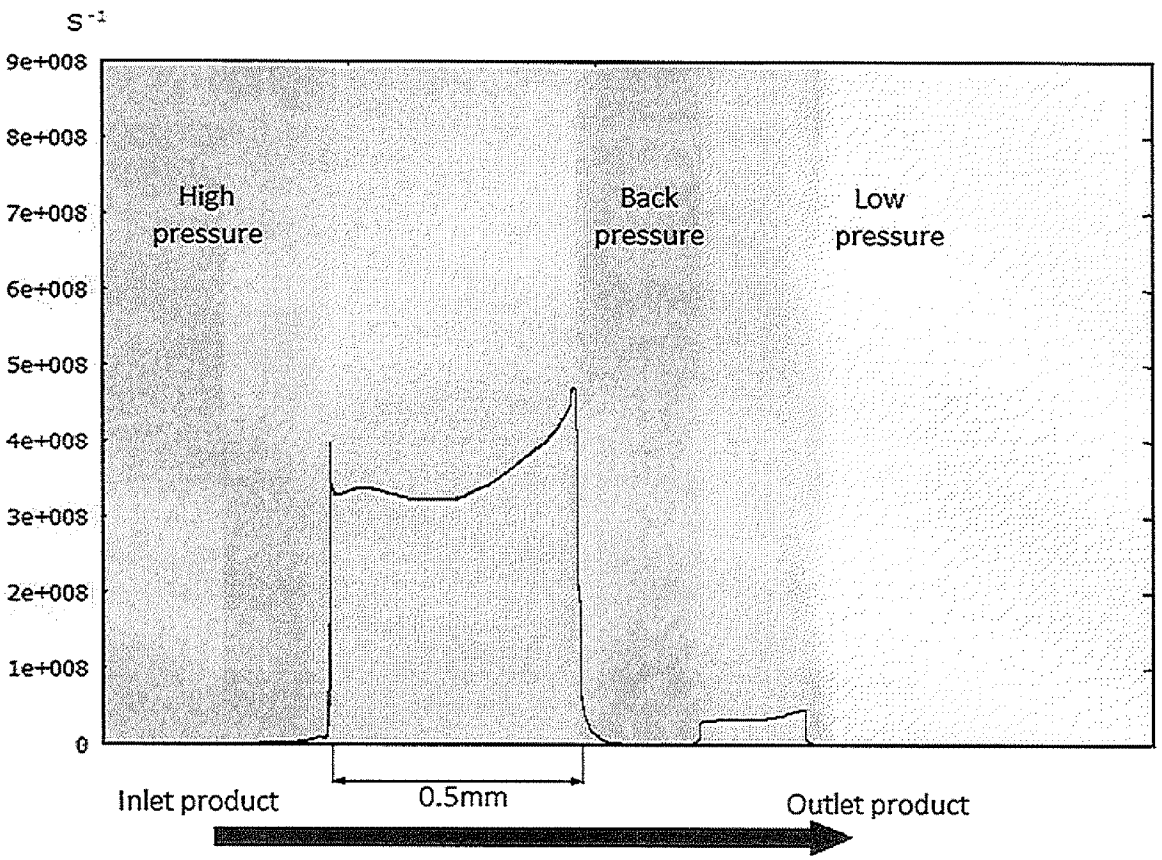
Figure 4:
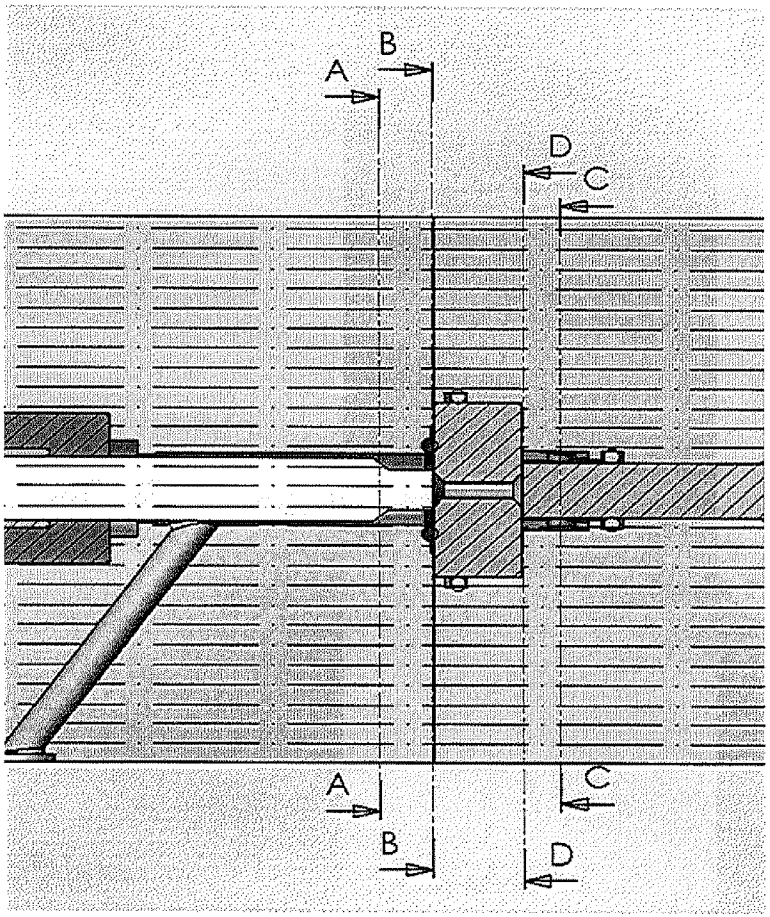
Figure 5A:
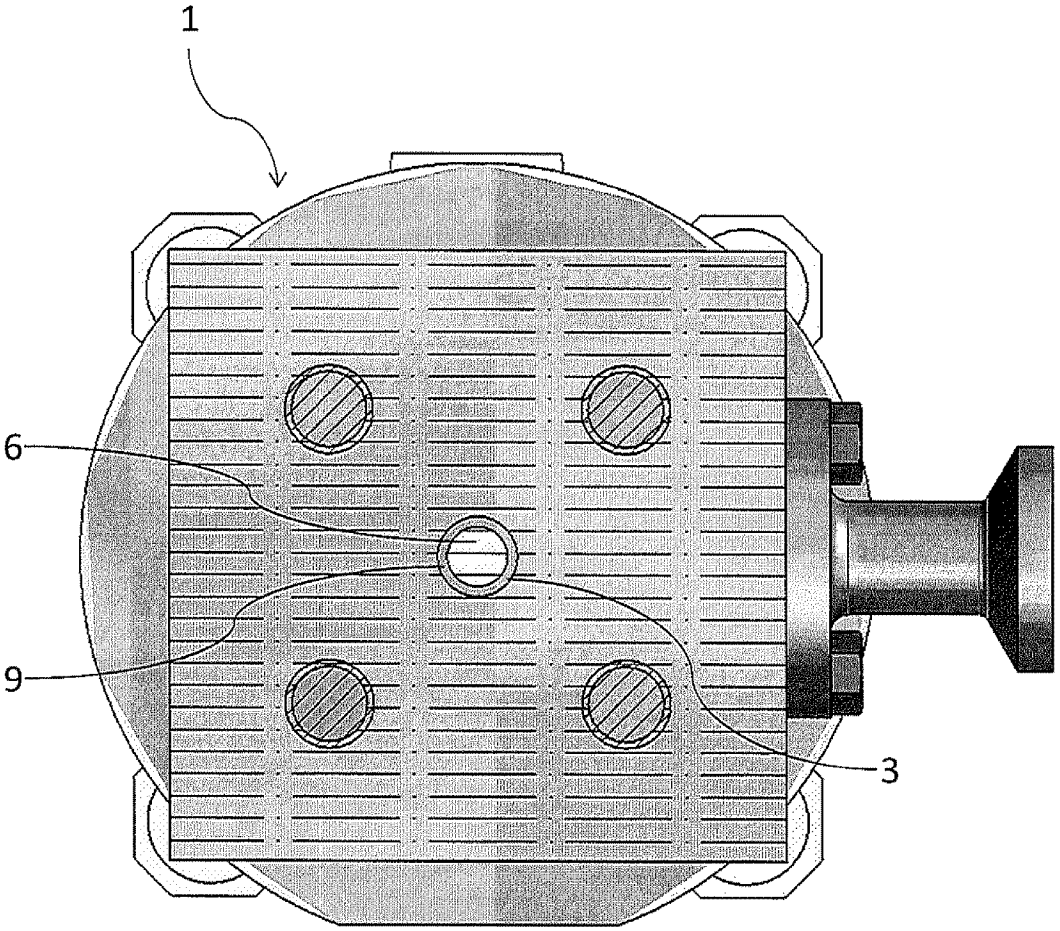
Figure 5B:
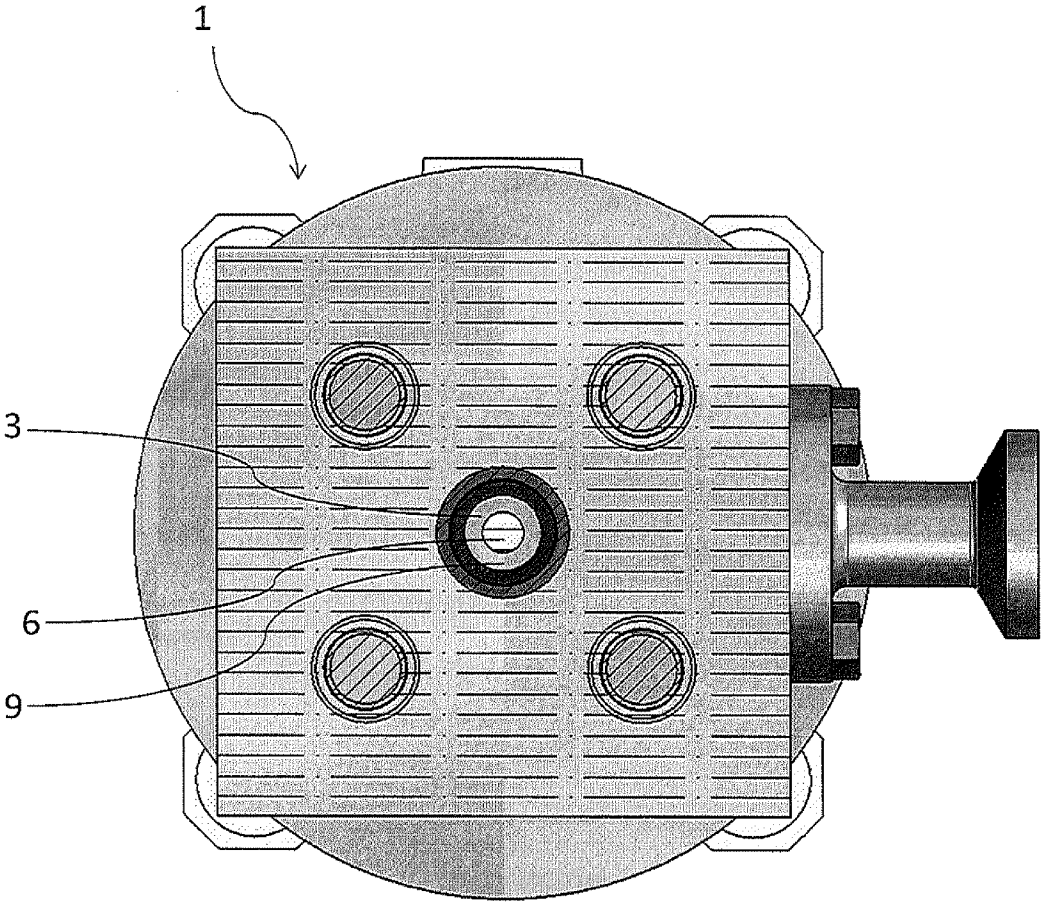
Figure 5C:
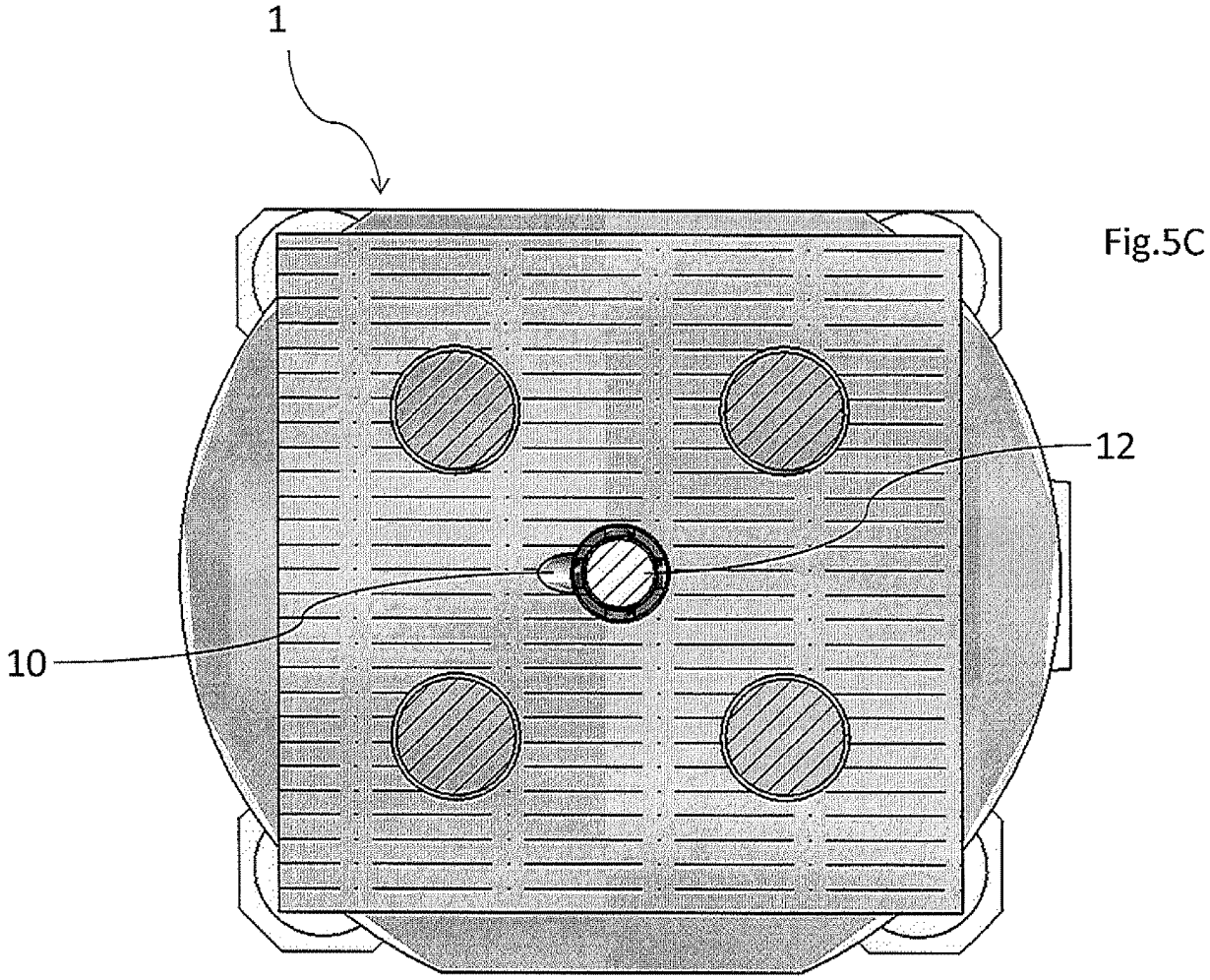
Figure 5D:
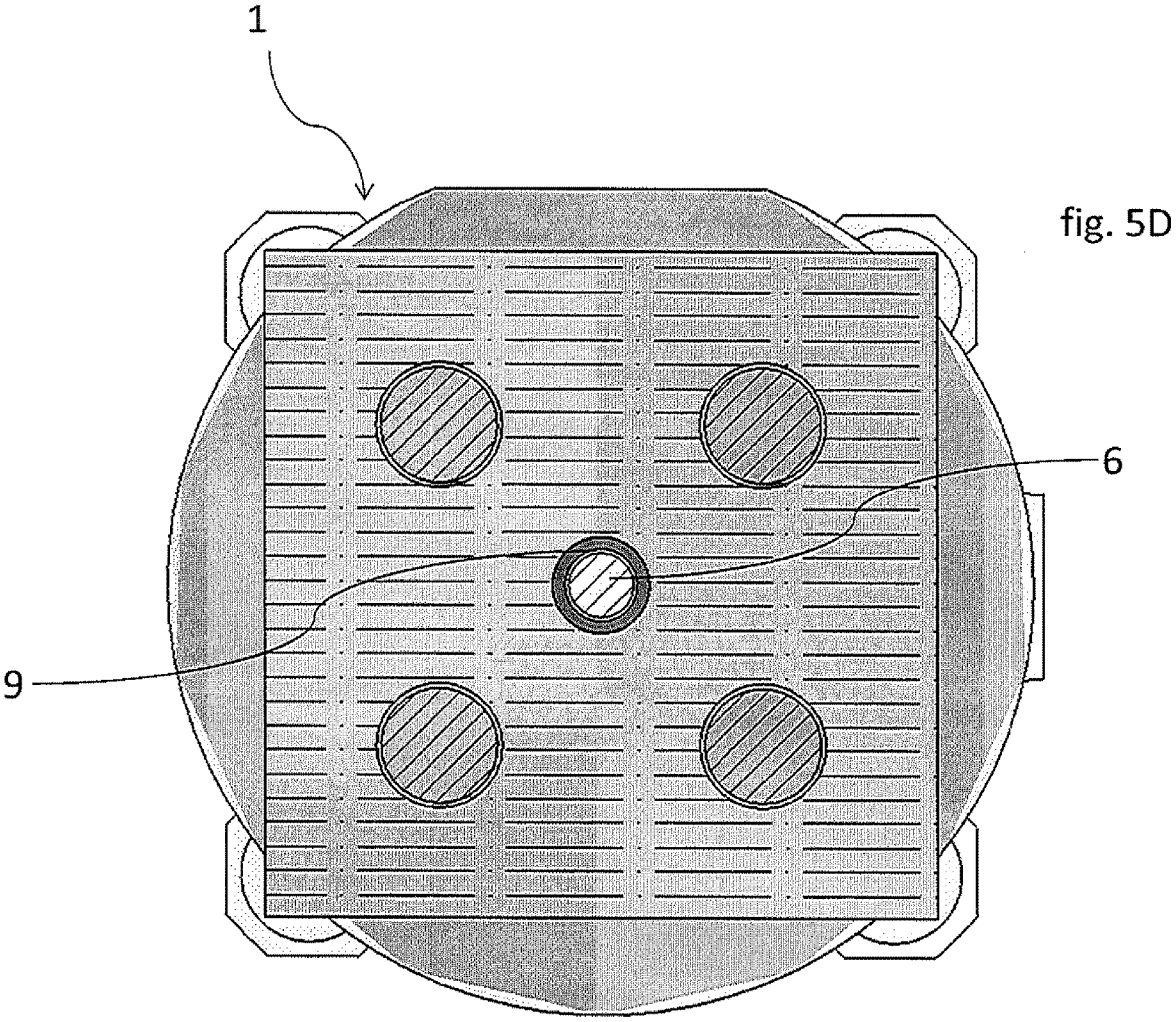
Figure 6:
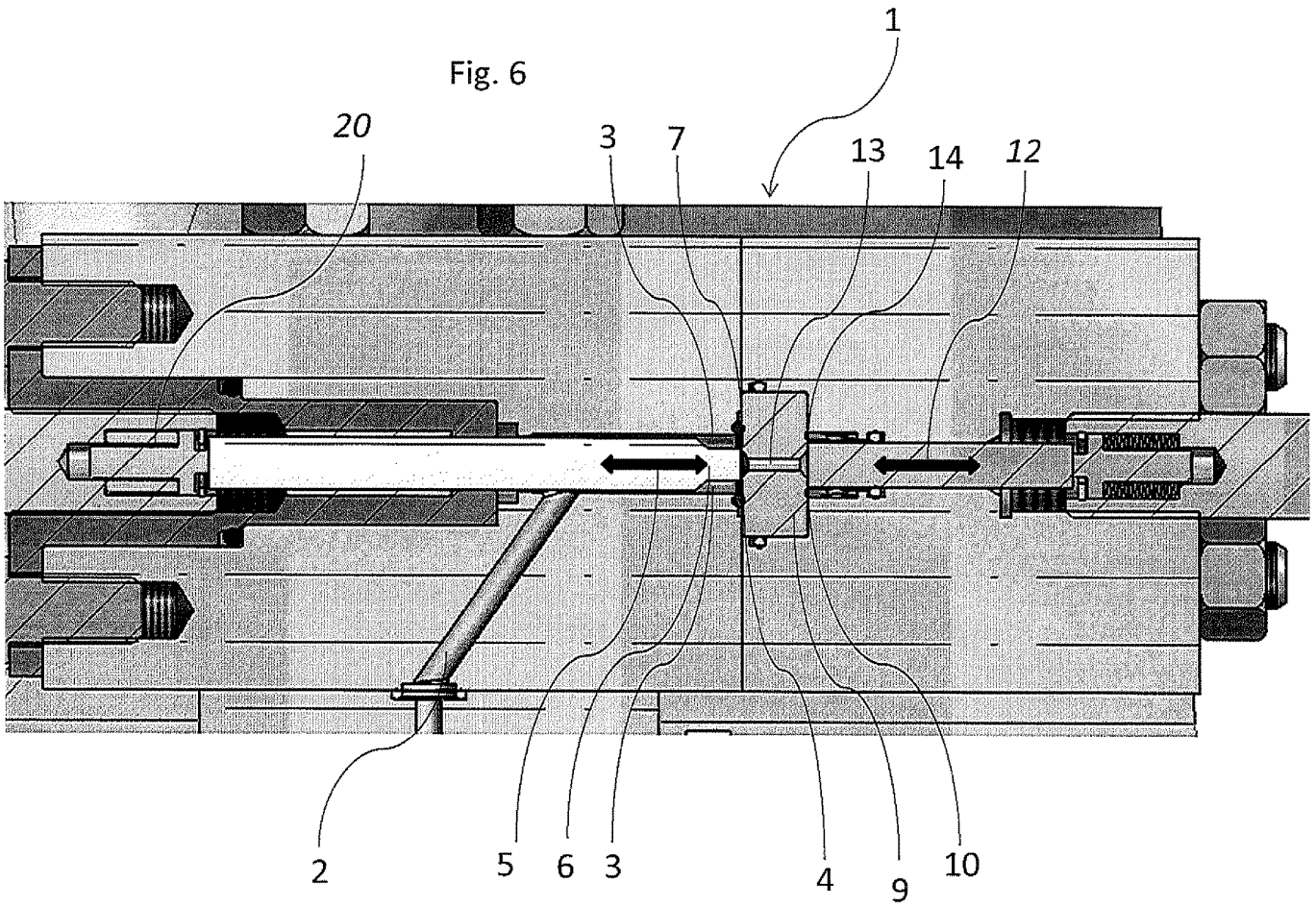
Figure 7:
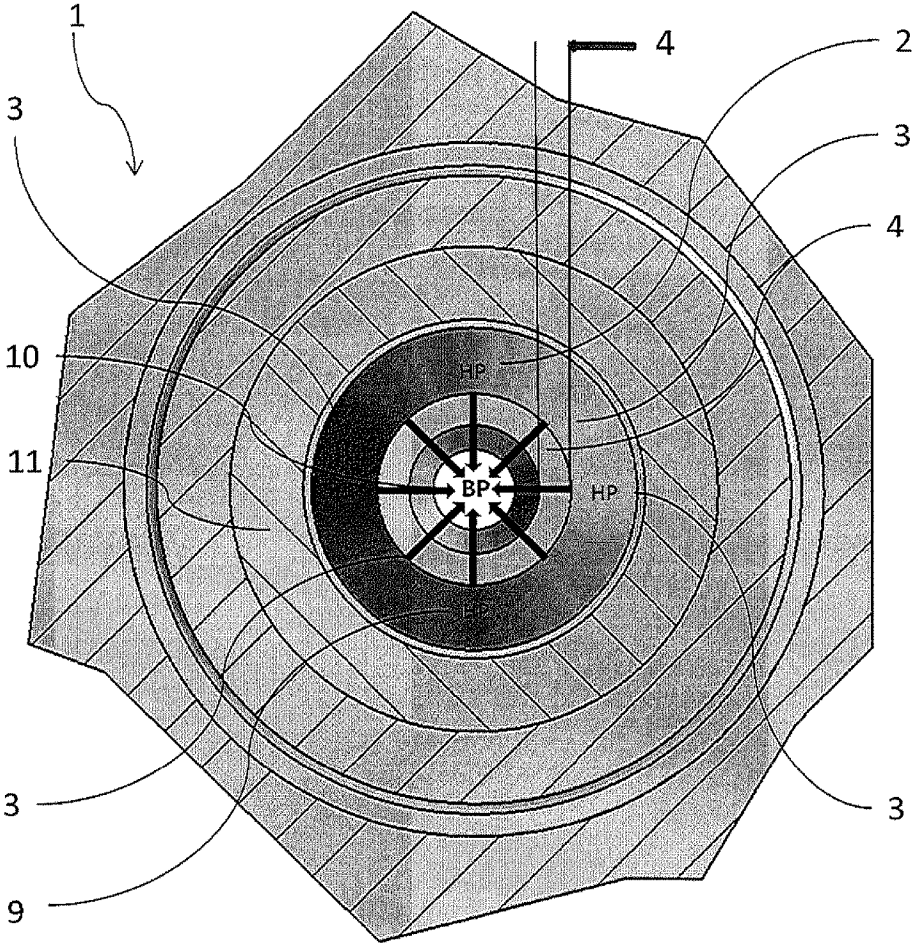
Figure 8:
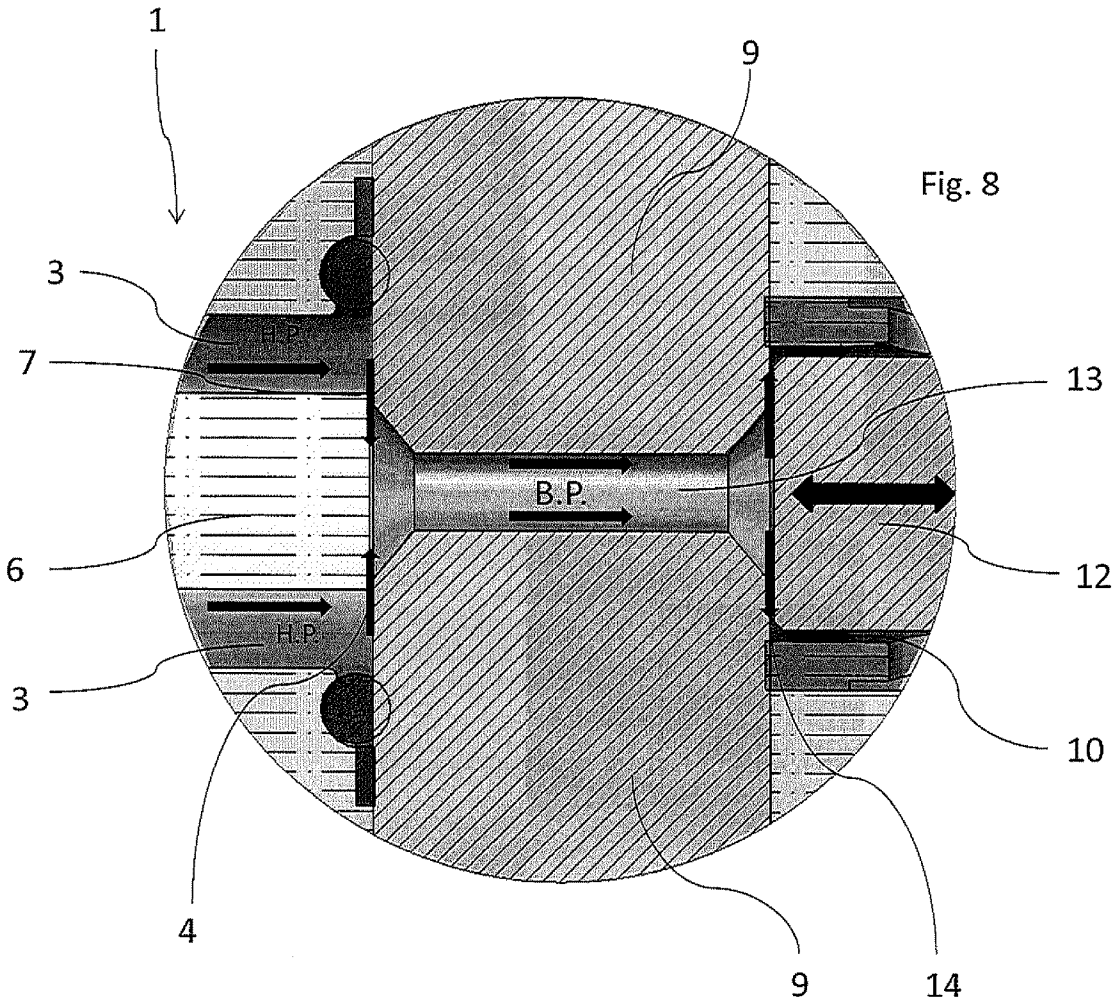
Figure 9A:
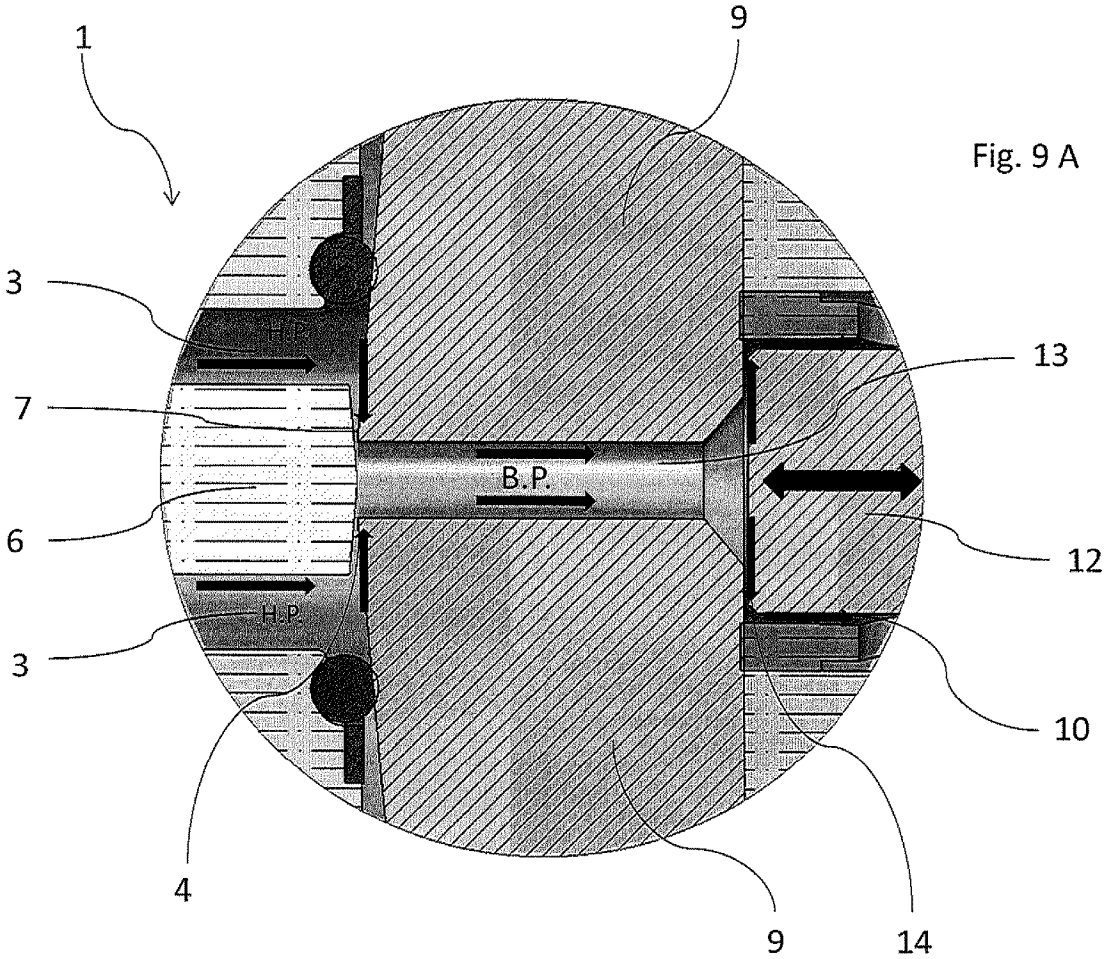
Figure 9B:
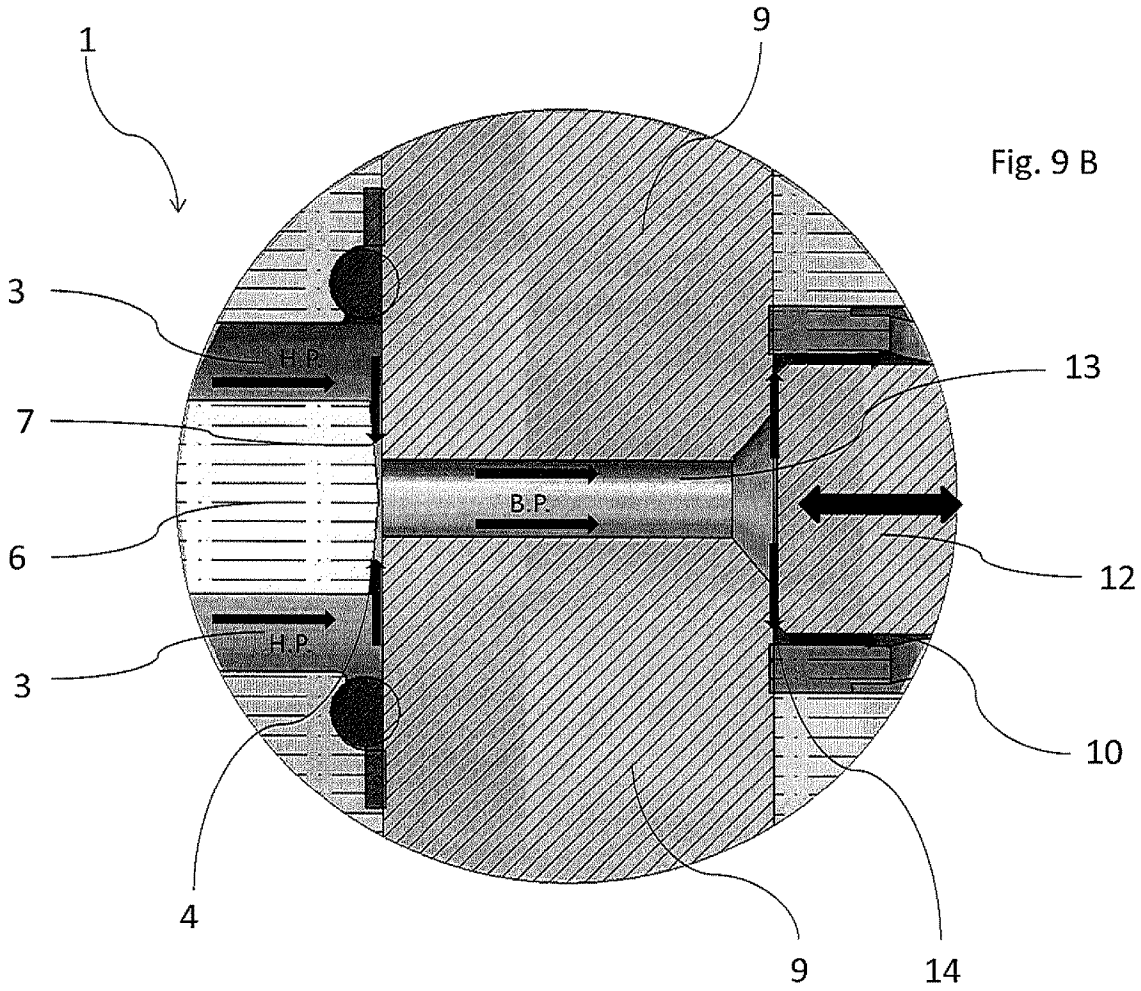
Figure 9C:
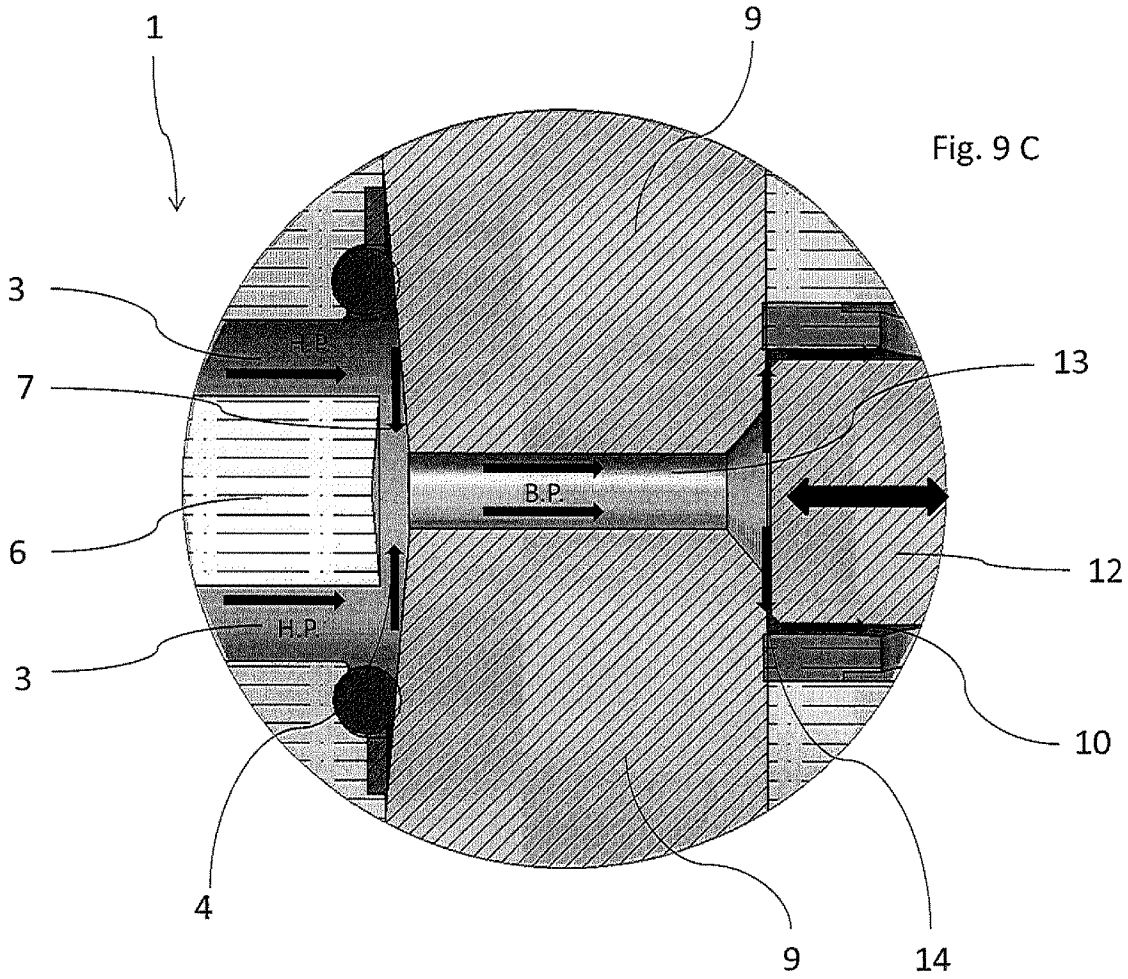
Figure 9D:
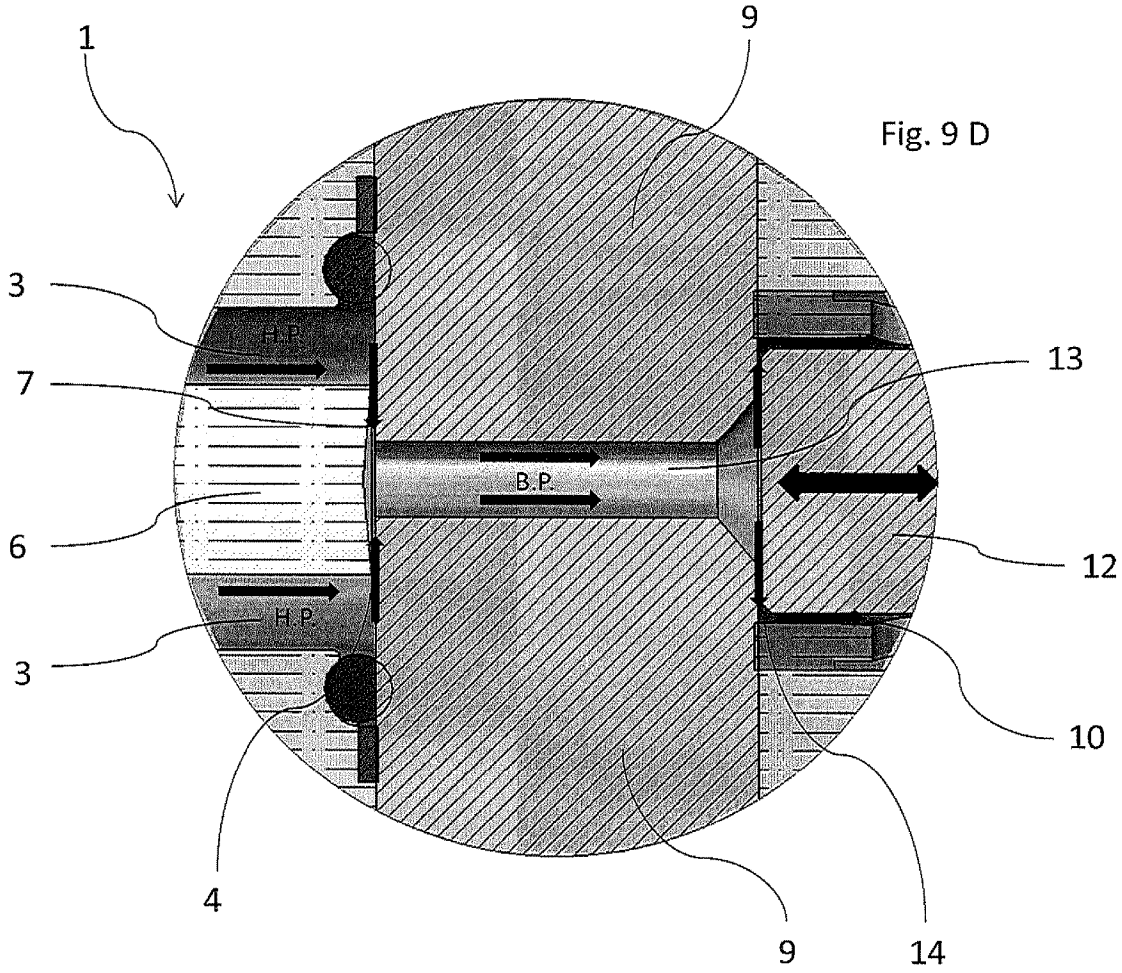
Figure 10:
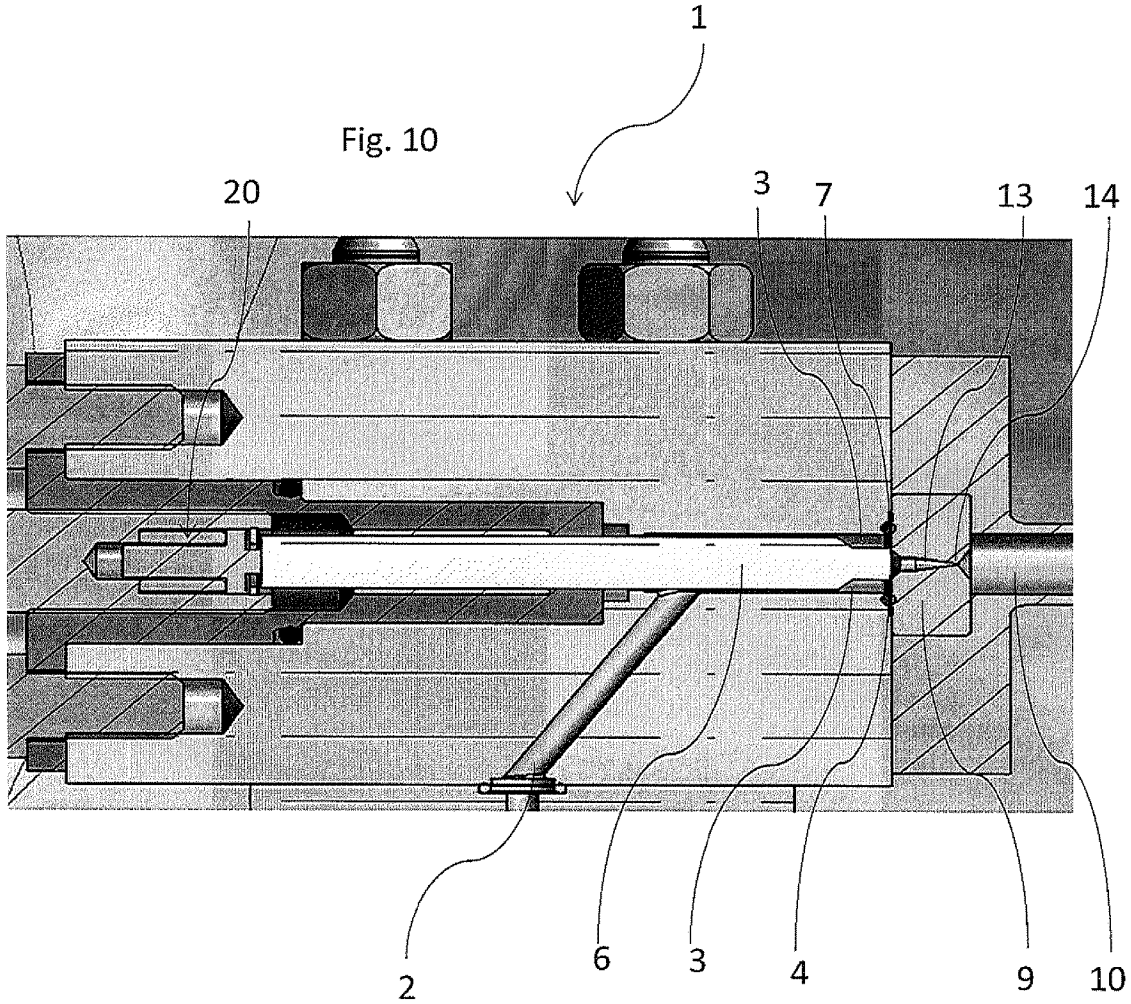
Figure 10A:
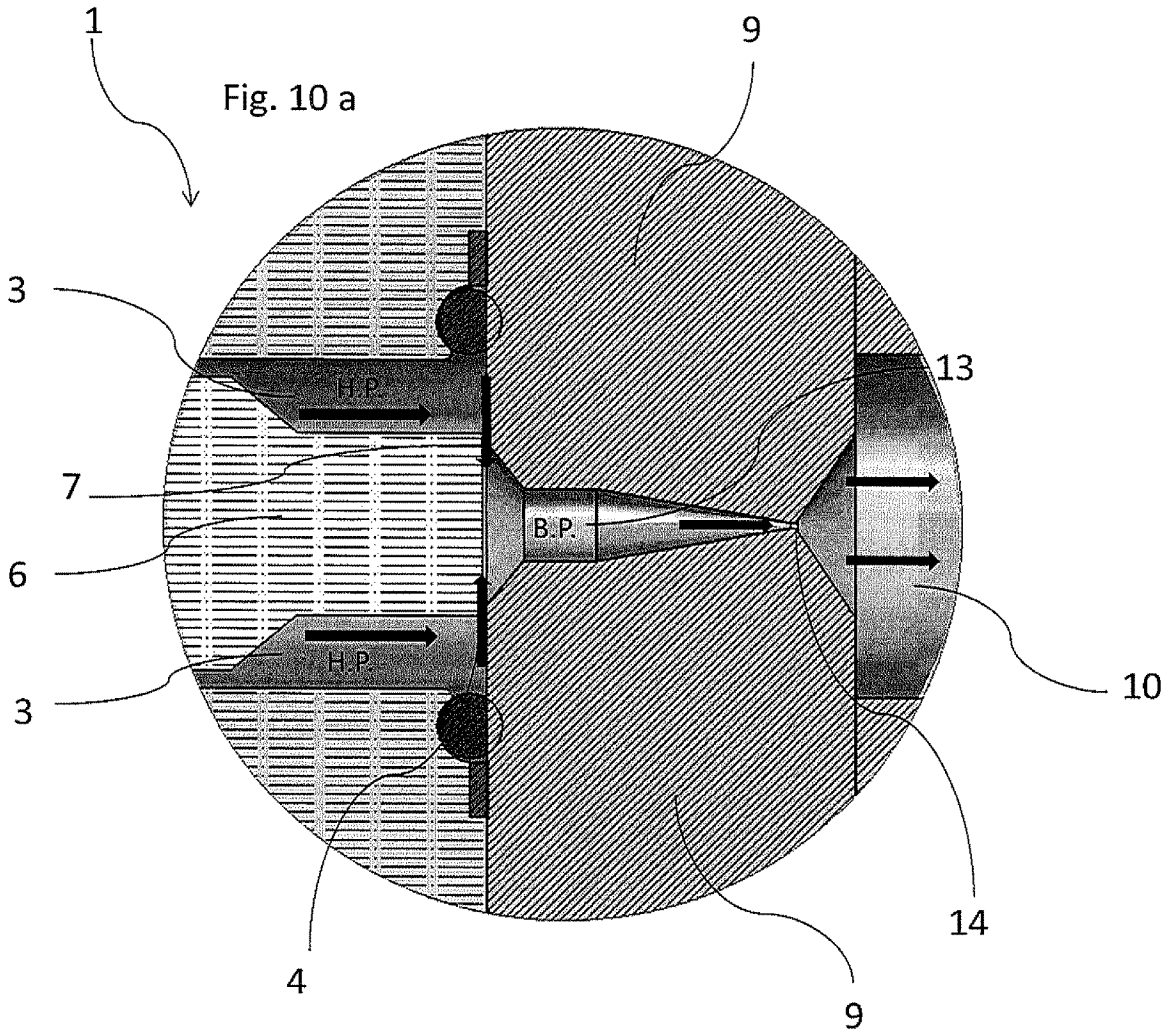

This and other characteristics will become clearer from the following description of a preferred embodiment that is illustrated purely by way of non-limiting example in the attached drawings, in which:

FIGS. 1 and 2 illustrate a homogenizing valve of the prior art, complete with product flow lines, in a longitudinal section and in a cross section, respectively;

FIG. 3 graphically illustrates the pattern of the shear rate (cutting force) of a valve of the prior art;

FIGS. 3A, 3B and 3C graphically illustrate the pattern of the shear rate (cutting force) of the homogenizing apparatus constituting the object of the present invention according to three different embodiments;

FIG. 4 illustrates a homogenizing valve according to the present invention in a longitudinal section;

FIGS. 5A, 5B, 5C and 5D illustrate the valve appearing in FIG. 4, in a sectional view along line A-A, in a sectional view along line B-B; in a sectional view along line C-C, and in a sectional view along line D-D, respectively;

FIGS. 6, 7, and 8 are enlargements of FIGS. 4 and 5, complete with the flow lines;

FIGS. 9A, 9B, 9C and 9D represent the view appearing in FIG. 8 according to variants of the combinations of the cooperating element and the first deflector plug, complete with the flow lines;

FIGS. 10 and 10*a* illustrate a variant in which the back pressure is realized by means of a calibrated orifice.

Figure 11:
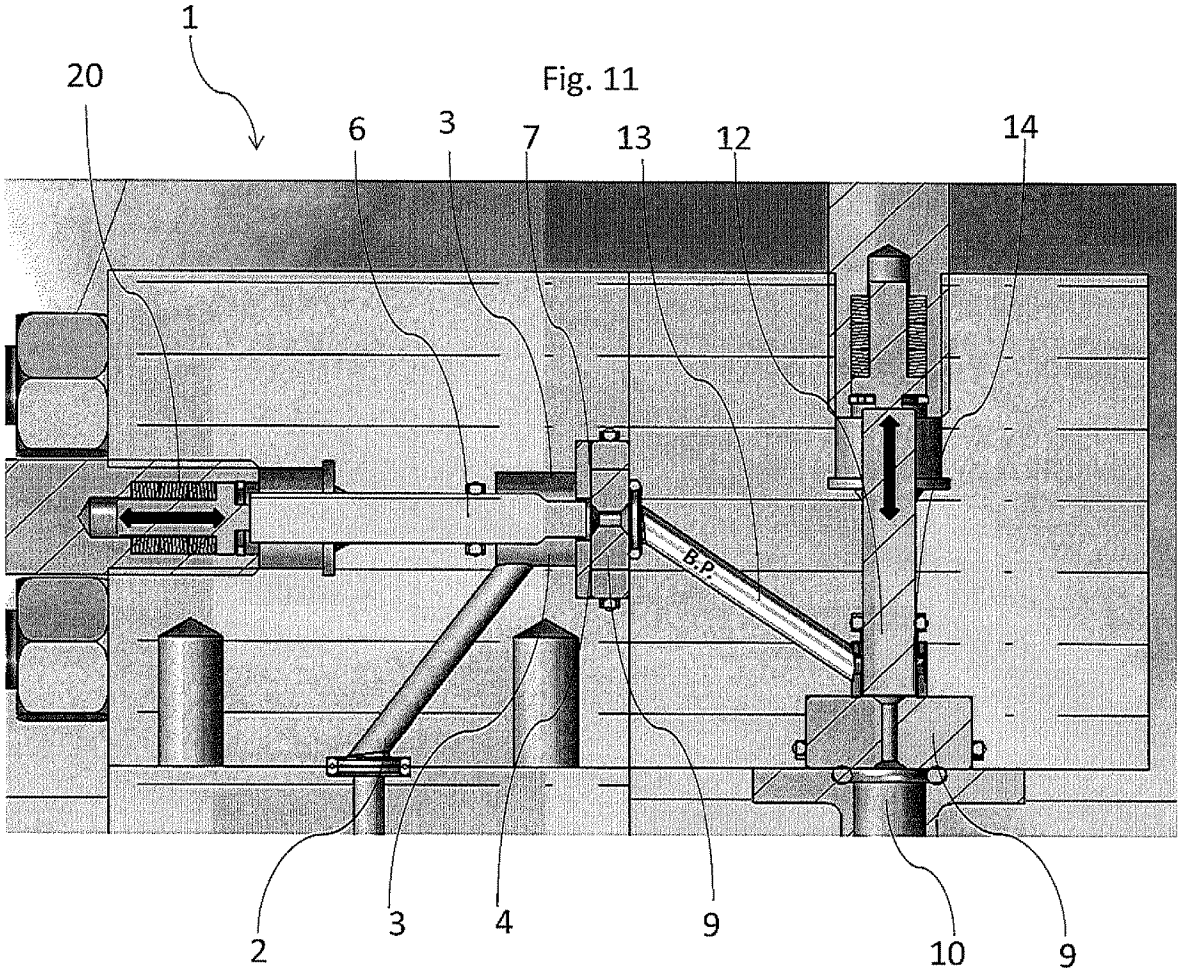
Figure 12:
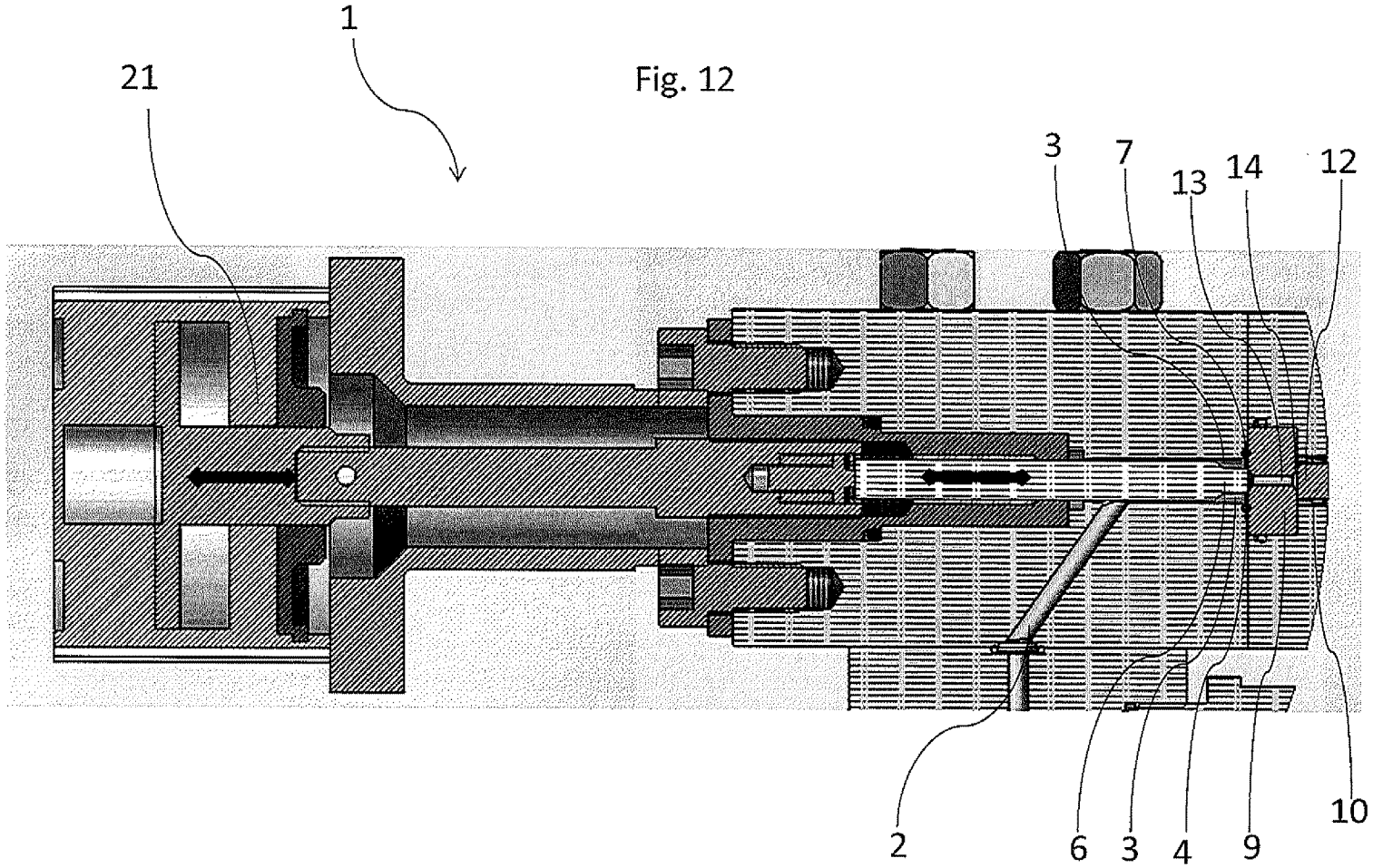

FIG. 11 illustrates a variant in which the back pressure is realized by setting two apparatuses or two "first stages" in a series;

FIG. 12 illustrates a special use of pneumatic cylinders.

DETAILED DESCRIPTION OF PREFERRED EMBODIMENTS OF THE INVENTION

Higher pressure zones and lower pressure zones are indicated in the figures by HP and LP, respectively, whereas BP indicates back pressure zones.

With reference to the figures, the number 1 indicates a homogenizing apparatus or valve in its entirety and provided with an inlet 2 for a fluid to be homogenized.

The fluid may be constituted for example by emulsions (liquids in liquids having the characteristics of being immiscible and often differing in density), suspensions (powders in liquids having the characteristics of being immiscible and often differing in density), or colloidal systems (liquid in immiscible liquid or solid of sizes of less than 1 μm).

In the present valve, the flow of product coming from the inlet 2 at a given pressure (normally high pressure) proceeds in a toroidal chamber 3 towards a homogenizing zone involving references 4, 6, 7, 13 and 14.

The annular chamber 3 encloses a pusher 5 therewithin that is controlled by suitable actuators and that bears at its tip a deflector plug 6 (called the "adjustable flow deflector plug"), a shear rate (cutting speed) regulator or deflector plug for calibrating the cutting force.

In the new meaning, the task of the deflector plug, together with the interacting element, is to divert the flow from a longitudinal course to an external and concentric, radial course towards the interior. In addition, with this device it is possible to change the intensity of the treatment without substantially changing the geometry that characterizes the system, thus a chamber with a circular or similar base that narrows over a concentric chamber also having a circular or similar base, but of smaller volume.

The homogenization step takes place in the homogenizing zone 4, 6, 7, 13 and 14, following, in a gap, a travel that in an innovative and original manner proceeds from the exterior towards the interior, that is, from a zone having a larger diameter (or larger volume) to a zone having a smaller diameter (or smaller volume): the system finds completion in cooperation with back pressure supplied by a second deflector plug 12, which, by supplying the necessary back pressure, contributes to administrating the shear rate and stabilizes the operation of the entire apparatus, making its configuration complete.

Micronization/homogenization is intended as the process that begins in the zone 4 and continues until reaching a low pressure zone or outlet 10, after a back pressure zone, all of which in an integrated apparatus capable of generating a head loss and thus back pressure.

Reference number 7 indicates both the gap (hollow space in FIG. 8) and the course (travel) 4 (FIG. 7) from the exterior inwards traveled by the particles in the active homogenization zone.

Together with the deflector plug 6, the task of an interacting element 9, also called the "flow deflector element" or "cooperating element", interacting with both deflector plugs 6 and 12, is to divert the flow from outside of a circular section inwards, thus contributing to the formation of a characteristic shear rate pattern. In addition, together with the deflector plug 6, it conveys the flow towards a mutual impact due to the more constricted volume.

The elements 6 and 9 interacting with each other are not necessarily parallel to each other. In fact, the reciprocal configuration of the face-to-face surfaces of the elements 6 and 9 is perfected until reaching the most suitable shear rate pattern possible for maximizing the effectiveness of the homogenizing action. All of this is based on the type of product, the passage generated between the elements 6 and 9 and the flow rate one intends to utilize.

The inclinations (FIGS. 9A, 9B, 9C and 9D) of the surfaces can be as follows:

- both converging (FIG. 9A) symmetrically towards a central zone (the surfaces approach each other);
- only the deflector plug 6 is convergent, with respect to the "parallelism" of the interacting element 9 (FIG. 9B); or vice versa only the surface of the interacting element is convergent with respect to the "parallelism" of the deflector plug 6 element.
- both diverging (FIG. 9C) (distancing of the surfaces towards the central zone);
- only the deflector plug 6 is divergent, with respect to the "parallelism" of the interacting element 9 (FIG. 9D); or vice versa only the surface of the interacting element is divergent with respect to the "parallelism" of the deflector plug 6 element.

The use of the adjustable cooperating element shared by two stages (first stage with the first deflector plug 6, the second step with the second deflector plug 12) allows for a useful life of the element that is twice as long as that existing in standard configurations because the cooperating element 9 is reversible (i.e., double faced) owing to the fact that the diameters of the deflector plugs 6 and 12 and thus of the wear marks they create, are different (FIG. 8).

The cooperating-interacting element 9 can contain, partially or completely, a particular section with narrowing and subsequent widening capable of conferring greater velocity towards the outlet edge of the insert, that is, towards the central hole (de Laval nozzle).

Along its travel inside the valve, the fluid encounters the deflector plug 6 and the interacting element 9 substantially at the same time.

Following the homogenization step 4-7, the product proceeds towards an outlet 10, which is substantially constituted by another gap afforded between the cooperating element 9 and the seat of the second deflector plug 12.

At the exit 10, the potential energy of the product is lower than its potential energy at the inlet 2.

The originality of the process lies above all in the fact that the phenomenon of micronization takes place owing to the use of a cooperating element together with two deflector plugs that provide a conversion of the potential energy (pressure) of the system into velocity and thus the development of a particular shear rate pattern throughout the entire process of micronization, a shear rate pattern suitable for creating efficiency.

The conversion of pressure into velocity along the course of travel is of particular interest: in the configuration of the prior art (see graph in FIG. 3), there is a change from a high shear rate down to a low shear rate as a result of the geometry, which tends to widen (i.e., an increase in the useful volume of the valve).

In the innovative configuration according to the present invention, however, the shear rate increases until it reaches a maximum rate in the outlet edge (towards the central hole) and this is certainly a more efficient process for using energy especially for products that are susceptible to elongational breakup. Essentially, as a logical result, the shear rate increases, as the volume in which the product flows becomes more constricted.

The use of integrated back pressure in the homogenizing apparatus creates, an ordered flow that is subject to minor micro fluctuations and thus more efficient in avoiding energy loss.

The energy dissipated at the centre facilitates micronization rather than being dispersed outwards on the impact ring, thereby increasing the contribution thereof in the micronizing effect.

With the deflector plugs 6 and 12 being tightly integrated and associated with the cooperating element 9, the relative velocity of the radially opposed fluid veins that collide in the central point of the interacting element increases and thus the impact energy and the contribution to the homogenizing effect significantly increase.

Keeping in mind that the kinetic energy equation is $E=1/2\ mv^2$:

the doubling of the collision velocity, for example (derived from the vector sum) yields a contribution that is four times greater, with respect to traditional methods (the velocity being squared).

Considering a dispersion (solid granules), the collision increases the probability of an impact in the dispersed phase with resulting breakup by virtue of the higher energy involved.

This advantageously makes it possible to eliminate the impact ring (8 in FIG. 1), which is instead an essential element in the homogenizing valves of the known type.

Considering the dispersed phase of a liquid, the use of the conversion of pressure into velocity with a shear rate gradient that tends to increase rather than decrease or remain constant, and then increase again in the second part of the system, is even more advantageous.

The present apparatus first enables elongational stretching of the micronizable phase so as to then break the product particles owing to an excess of cutting force; the cutting force in the device inlet up to a maximum intensity is preparatory for the final action of micronization realized in the zone 4 and with the elements 6, 7, 13 and 14. In the prior art, much of the energy ends up in heat rather than being used to a greater extent for breaking up the particles.

The present invention is applicable on all types of machines, for large and small flow capacities with operating pressures that according to the current state of the art range from 0 to 200 MPa.

The present invention enables better homogenization of the product and a reduction of wear affecting the elements of the micronizing valve.

In fact, the impact ring 8 can eventually be replaced with a simple spacer, which, unlike the impact ring, is, not subject to wear given that the high velocity particles do not collide against it. The logical result is that if the impact ring is eliminated, the energy which in the prior art is used in eroding the same component is now employed to contribute to increasing the homogenizing effect.

Flow rate discontinuity originating from the use of positive displacement pumps with one or more pistons generates a flow that is not constant; the use of homogenizing and micronizing devices controlled by elastic systems, springs 20 (FIG. 11), pneumatic cylinders 21 (FIG. 12) or specifically designed and calculated equivalents, enables modification of the heights of the gap created between the cooperating element 9 and the deflector plugs 6 and 12 in a continuous manner.

In a certain sense, they follow the flow rate profile, increasing the efficiency of the system. In other words, they adapt to flow rate fluctuations dynamically and continuously.

The back pressure derived from the interaction of the cooperating element 9 and the deflector plug 12 can be realized according to three different modes:

- back pressure activated in a standard adjustable manner (FIG. 8), as described hereinabove;
- back pressure realized by means of a non-adjustable calibrated orifice (FIGS. 10-10*a*);
- back pressure realized by setting two apparatuses or two "first stages" in a series (FIG. 11).

A particular configuration consists of the configuration with a "de Laval nozzle" positioned towards the outlet edge of the first interaction zone (towards the central hole). A "de Laval nozzle" is intended herein as a sectional narrowing (a passage between the interacting element 9 and the deflector plug 6) and a subsequent widening (bevelled shape of the interacting element, as illustrated).

The increase in the shear rate during travel of the fluid until reaching a maximum peak creating the characteristic pattern, the increase in impact velocity in the central zone of the interacting element shared by both deflector plugs, and the back pressure generated at the same time by the same cooperating element and the "de Laval nozzle" are the principal innovative elements of the present invention, related to the particular geometry of the valve and to the particular direction of the flow.

In the present invention, the deflector plugs can be adjusted independently so as to change the intensity of the treatment without substantially changing the geometry of the valve.

With reference to FIGS. 3A, 3B and 3C, which graphically illustrate the shear rate (cutting force) pattern in the homogenizing apparatus constituting the object of the present invention, according to three different embodiments, the shear rate initially increases in all three modes within the first stage, whereas in the second stage it may drop (FIG. 3A), remain substantially constant (FIG. 3B) or increase (FIG. 3C).

In the various embodiments, the number 13 indicates a channel with intermediate pressure or a back pressure channel, whereas 14 indicates a travel with a gap, which is part of the second stage and similar to the travel 4 with a gap 7 of the first stage.

A hole is afforded in the interacting element 9, and in the end portion the hole is flared (i.e., it widens) and the deflector plugs 6 and 12 are independently adjustable to change the intensity of the treatment without substantially changing the geometry of the valve.

Some experimental data are reported herein as proof of the advantages of the present invention: with the results being the same, less pressure/energy is used and thus efficiency is increased.

Product: 5% Oil, 2% Tween 80® and 93% $H_2O$ Emulsion

| Particle Size Nm | Pressure: Standard apparatus | Pressure: New apparatus | Efficiency increase |
|---|---|---|---|
| 349 | 25 MPa | 15 MPa | +40% |

| PDI Polydispersity Index (ISO standard 13321) | Pressure: Standard apparatus | Pressure: New apparatus | Efficiency increase |
|---|---|---|---|
| 0.358 | 25 MPa | 12 MPa | +52% |

Product: Liposomes

| Particle Size Nm | Pressure: Standard apparatus | Pressure: New apparatus | Efficiency increase |
|---|---|---|---|
| 95 nm | 100 MPa X4 cycles | 40 MPa bar X4 cycles | +250% |

The invention claimed is:

1. A homogenizing apparatus (1) comprising:

an inlet (2) for receiving a pressurized fluid, possibly also containing solid particles;

a zone wherein homogenization of the fluid takes place;

an outlet (10) for the fluid at a lower pressure with respect to the pressure at said inlet (2), wherein, in the homogenization zone, the fluid passes, from a zone having a larger diameter to a zone having a smaller diameter, the homogenization zone comprising an interacting element (9) shared by a first stage, equipped with a first deflector plug (6), and a second stage suitable for creating back pressure, equipped with a second deflector plug (12), said interacting element (9) being unmovable and solidly fixed to the first detector plug (6) and to the second detector plug (12), where the deflector plugs (6, 12) operate with the interacting element (9) they share, generating an increase in the shear rate within the first stage, wherein the interacting element (9) contains a De Laval nozzle, that is a convergent-divergent nozzle that acts on the fluid going from the first deflector plug (6) to the second deflector plug (12), wherein the deflector plugs are adjustable independently of a flow rate of the fluid so as to change the intensity of the homogenization without substantially changing the geometry of the apparatus, the first deflector plug (6), together with the interacting element (9), diverting the flow of the fluid from outside of a circular section having a larger diameter inwards to a circular section having a smaller diameter.

2. The apparatus according to claim 1, wherein a hole is afforded in the interacting element (9), said hole widening in an end portion of the interacting element (9) facing the second deflector plug (12).

3. The apparatus according to claim 1, wherein the first deflector plug (6) has a surface that faces a surface of said interacting element (9), both said surfaces being inclined in such a way to be symmetrically convergent or divergent from a central zone.

4. The apparatus according to claim 1, wherein the first deflector plug (6) has a surface that faces a surface of said interacting element (9), said surfaces being inclined in such a way that one surface is convergent and the other surface is divergent from a central zone.

* * * * *